US008731446B2

(12) United States Patent
Takahashi et al.

(10) Patent No.: US 8,731,446 B2
(45) Date of Patent: May 20, 2014

(54) DEVELOPER SUPPLY DEVICE FOR SUPPLYING CHARGED DEVELOPMENT AGENT TO INTENDED DEVICE AND IMAGE FORMING APPARATUS HAVING THE SAME

(75) Inventors: Keisuke Takahashi, Aichi (JP); Kazuna Taguchi, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 382 days.

(21) Appl. No.: 13/048,264

(22) Filed: Mar. 15, 2011

(65) Prior Publication Data

US 2011/0236078 A1 Sep. 29, 2011

(30) Foreign Application Priority Data

Mar. 23, 2010 (JP) ..... 2010-065441

(51) Int. Cl.
*G03G 15/08* (2006.01)

(52) U.S. Cl.
USPC ..... 399/281; 399/289; 361/233

(58) Field of Classification Search
USPC ..... 399/281, 289
See application file for complete search history.

(56) References Cited

U.S. PATENT DOCUMENTS

| | | | | |
|---|---|---|---|---|
| 5,027,157 | A * | 6/1991 | Hotomi et al. | 399/253 |
| 5,761,591 | A * | 6/1998 | Yamaguchi | 399/289 |
| 5,899,608 | A * | 5/1999 | Eklund et al. | 399/266 |
| 5,950,057 | A * | 9/1999 | Erhardt et al. | 399/266 |
| 6,600,892 | B2 * | 7/2003 | Kamimura et al. | 399/281 |
| 6,941,098 | B2 | 9/2005 | Miyaguchi et al. | |
| 7,062,204 | B2 | 6/2006 | Miyaguchi et al. | |
| 8,095,052 | B2 * | 1/2012 | Nishiwaki et al. | 399/281 |
| 8,112,019 | B2 * | 2/2012 | Onoda et al. | 399/281 |
| 8,275,298 | B2 * | 9/2012 | Maeda et al. | 399/281 |
| 8,311,462 | B2 * | 11/2012 | Okamura | 399/265 |
| 8,326,188 | B2 * | 12/2012 | Nishiwaki | 399/266 |
| 8,326,190 | B2 * | 12/2012 | Hattori | 399/281 |

(Continued)

FOREIGN PATENT DOCUMENTS

| | | |
|---|---|---|
| JP | 01-031605 B | 6/1989 |
| JP | 08-146732 | 6/1996 |

(Continued)

OTHER PUBLICATIONS

JP Notification of Reasons for Rejection dated Dec. 28, 2011 in corresponding Application No. 2010-065441; English Translation.

*Primary Examiner* — David Gray
*Assistant Examiner* — Geoffrey Evans
(74) *Attorney, Agent, or Firm* — Banner & Witcoff, Ltd.

(57) ABSTRACT

A developer supply device includes a developer-carrying body having a developer-carrying surface that faces an intended device in a first position and moves in a moving direction, a first transfer board that faces the developer-carrying surface in a second position upstream relative to the first position in the moving direction and transfers the developer to the second position in a direction opposite to the moving direction in the second position, an electrification member facing the developer-carrying surface in a third position downstream relative to the second position and upstream relative to the first position in the moving direction, and a second transfer board that faces the developer-carrying surface in a fourth position downstream relative to the first position and upstream relative to the second position in the moving direction and transfers the developer to a developer storage section in a direction identical to the moving direction in the fourth position.

16 Claims, 5 Drawing Sheets

(56) References Cited

U.S. PATENT DOCUMENTS

| | | | | |
|---|---|---|---|---|
| 8,406,662 | B2 * | 3/2013 | Maeda | 399/281 |
| 8,412,078 | B2 * | 4/2013 | Nishiwaki | 399/254 |
| 8,457,535 | B2 * | 6/2013 | Nishiwaki | 399/281 |
| 8,494,420 | B2 * | 7/2013 | Taguchi et al. | 399/281 |
| 8,498,557 | B2 * | 7/2013 | Nishiwaki | 399/285 |
| 8,532,546 | B2 * | 9/2013 | Nishigaki et al. | 399/281 |
| 8,606,151 | B2 * | 12/2013 | Okamura | 399/289 |
| 8,626,021 | B2 * | 1/2014 | Taguchi | 399/103 |
| 2002/0141790 | A1 * | 10/2002 | Kamimura et al. | 399/279 |
| 2003/0210928 | A1 | 11/2003 | Miyaguchi et al. | |
| 2005/0025525 | A1 * | 2/2005 | Horike et al. | 399/252 |
| 2005/0152717 | A1 | 7/2005 | Miyaguchi et al. | |
| 2009/0080942 | A1 * | 3/2009 | Nishiwaki et al. | 399/254 |
| 2009/0175662 | A1 | 7/2009 | Nishiwaki | |
| 2010/0247161 | A1 * | 9/2010 | Hattori | 399/262 |
| 2010/0247166 | A1 * | 9/2010 | Nishiwaki et al. | 399/281 |
| 2010/0316418 | A1 * | 12/2010 | Sato et al. | 399/281 |
| 2011/0103848 | A1 * | 5/2011 | Taguchi et al. | 399/281 |
| 2011/0188899 | A1 * | 8/2011 | Nishiwaki | 399/285 |
| 2011/0293335 | A1 * | 12/2011 | Takahashi et al. | 399/281 |
| 2011/0311278 | A1 * | 12/2011 | Onoda | 399/254 |
| 2011/0311282 | A1 * | 12/2011 | Okamura | 399/283 |
| 2012/0027471 | A1 * | 2/2012 | Nishigaki et al. | 399/281 |
| 2012/0076552 | A1 * | 3/2012 | Takahashi et al. | 399/281 |
| 2012/0201576 | A1 * | 8/2012 | Uno et al. | 399/281 |
| 2013/0243497 | A1 * | 9/2013 | Taku et al. | 399/281 |

FOREIGN PATENT DOCUMENTS

| | | |
|---|---|---|
| JP | 09-034249 | 2/1997 |
| JP | 2001-075357 | 3/2001 |
| JP | 2002-072687 A | 3/2002 |
| JP | 2003-265982 A | 9/2003 |
| JP | 2008-070803 | 3/2008 |

* cited by examiner

DEVELOPER SUPPLY DEVICE FOR SUPPLYING CHARGED DEVELOPMENT AGENT TO INTENDED DEVICE AND IMAGE FORMING APPARATUS HAVING THE SAME

CROSS-REFERENCE TO RELATED APPLICATION

This application claims priority under 35 U.S.C. §119 from Japanese Patent Applications No. 2010-065441 filed on Mar. 23, 2010. The entire subject matter of the application is incorporated herein by reference.

BACKGROUND

1. Technical Field

The following description relates to one or more techniques for supplying charged development agent to an intended device.

2. Related Art

A developer supply device configured to supply charged development agent to an intended device has been known. The developer supply device includes a developer carrying body (a development roller), an upstream developer transfer unit, and a downstream developer transfer unit. The developer carrying body is provided with a developer carrying surface configured to hold and carry the charged development agent, and disposed to face an electrostatic latent image holding body (a photoconductive drum) as the intended device in a predetermined development area.

The upstream developer transfer unit has an upstream transfer surface that faces the developer carrying surface across a predetermined distance in an area upstream relative to the development area in a moving direction of the developer carrying surface. The upstream developer transfer unit is configured to generate an upstream transfer electric field (for transferring the development agent carried on the upstream transfer surface from an upstream side to a downstream side in the moving direction of the developer carrying surface). The downstream developer transfer unit has a downstream transfer surface that faces the developer carrying surface across a predetermined distance in an area downstream relative to the development area in the moving direction of the developer carrying surface. The downstream developer transfer unit is configured to generate a downstream transfer electric field (for transferring the development agent carried on the downstream transfer surface from an upstream side to a downstream side in the moving direction of the developer carrying surface).

SUMMARY

In a developer supply device of this kind, in order to supply the development agent to the intended device in a favorable manner, it is important to make the developer carrying surface hold and carry the development agent in a preferable fashion. Further, in order to enable the developer supply device of this kind to be incorporated into an image forming apparatus in a more improved manner, the developer supply device is required to be downsized.

Aspects of the present invention are advantageous to provide one or more improved techniques make it possible to downsize a developer supply device and make a developer carrying surface hold and carry development agent in a preferable fashion.

According to aspects of the present invention, a developer supply device is provided that is configured to supply charged development agent to an intended device. The developer supply device includes a developer carrying body having a developer carrying surface that is configured to carry the development agent thereon, formed as a cylindrical circumferential surface parallel to a first direction, and disposed to face the intended device in a first position where the development agent held on the developer carrying surface is supplied to the intended device, the developer carrying body being configured to rotate around an axis parallel to the first direction such that the developer carrying surface moves in a second direction perpendicular to the first direction, a casing including an opening opened toward the intended device and a developer storage section configured to store the development agent therein, the casing being configured to rotatably support the developer carrying body near the opening, a first transfer board housed in the casing so as to face the developer carrying surface in a second position, the second position, where the developer carrying surface faces an inside of the casing, being located upstream relative to the first position in the second direction, the first transfer board being configured to transfer the development agent from the developer storage section to the second position with a traveling-wave electric field generated when a multi-phase alternating-current voltage is applied to the first transfer board, such that the development agent is supplied onto the developer carrying surface in the second position, and transfer the development agent in a direction opposite to the second direction in the second position, an electrification member disposed to face the developer carrying surface in a third position that is located downstream relative to the second position and upstream relative to the first position in the second direction, the electrification member being configured to further charge the development agent supplied onto the developer carrying surface in the third position with an alternating electric field generated between the developer carrying body and the electrification member, and a second transfer board that is supported by an inner wall surface of the casing so as to face the developer carrying surface in a fourth position that is located downstream relative to the first position and upstream relative to the second position in the second direction, the second transfer board being configured to transfer the development agent to the developer storage section in a direction identical to the second direction in the fourth position, with a traveling-wave electric field generated when a multi-phase alternating-current voltage is applied to the second transfer board.

According to aspects of the present invention, further provided is an image forming apparatus, which includes a photoconductive body configured to form a developer image thereon, and a development agent supply device configured to supply charged development agent to the photoconductive body. The development agent supply device includes a developer carrying body that has a developer carrying surface that is configured to carry the development agent thereon, formed as a cylindrical circumferential surface parallel to a first direction, and disposed to face the photoconductive body in a first position where the development agent held on the developer carrying surface is supplied to the photoconductive body, the developer carrying body being configured to rotate around an axis parallel to the first direction such that the developer carrying surface moves in a second direction perpendicular to the first direction, a casing that includes an opening opened toward the photoconductive body, and a developer storage section configured to store the development agent therein, the casing being configured to rotatably support the developer carrying body near the opening, a first transfer board housed in the casing so as to face the developer carrying surface in a second position, the second position, where the developer carrying surface faces an inside of the casing, being located upstream relative to the first position in the second direction, the first transfer board being configured to transfer the development agent from the developer storage section to the second position with a traveling-wave electric field generated when a multi-phase alternating-current voltage is applied to the first transfer board, such that the development agent is supplied onto the developer carrying surface in the second position, and transfer the development agent in a direction opposite to the second direction in the second position; an electrification member disposed to face the developer carrying surface in a third position that is located downstream relative to the second position and upstream relative to the first position in the second direction, the electrification member being configured to further charge the development agent supplied onto the developer carrying surface in the third position with an alternating electric field generated between the developer carrying body and the electrification member, and a second transfer board that is supported by an inner wall surface of the casing so as to face the developer carrying surface in a fourth position that is located downstream relative to the first position and upstream relative to the second position in the second direction, the second transfer board being configured to transfer the development agent to the developer storage section in a direction identical to the second direction in the fourth position, with a traveling-wave electric field generated when a multi-phase alternating-current voltage is applied to the second transfer board.

BRIEF DESCRIPTION OF THE ACCOMPANYING DRAWINGS

Figure 4:
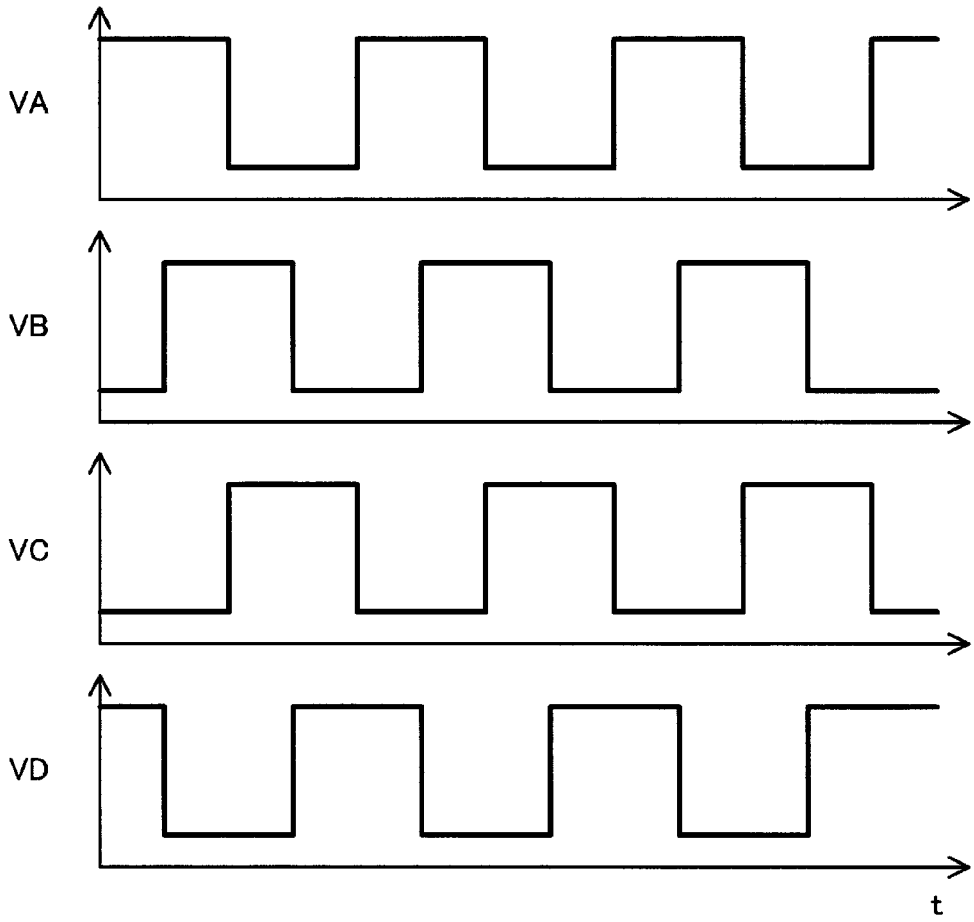

FIG. 4 exemplifies waveforms of voltages generated by power supply circuits for the transfer board in the embodiment according to one or more aspects of the present invention.

Figure 5:
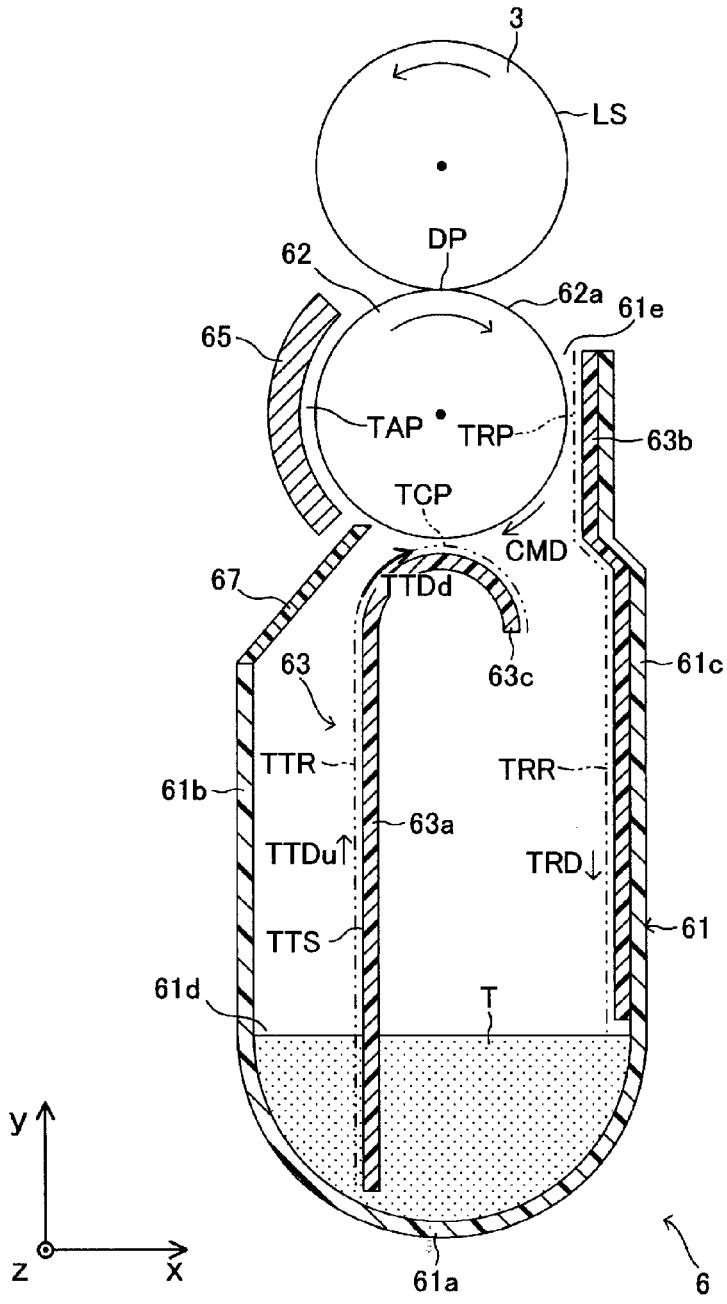

FIG. 5 is a cross-sectional side view of a toner supply device for the laser printer in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration>

Figure 1:
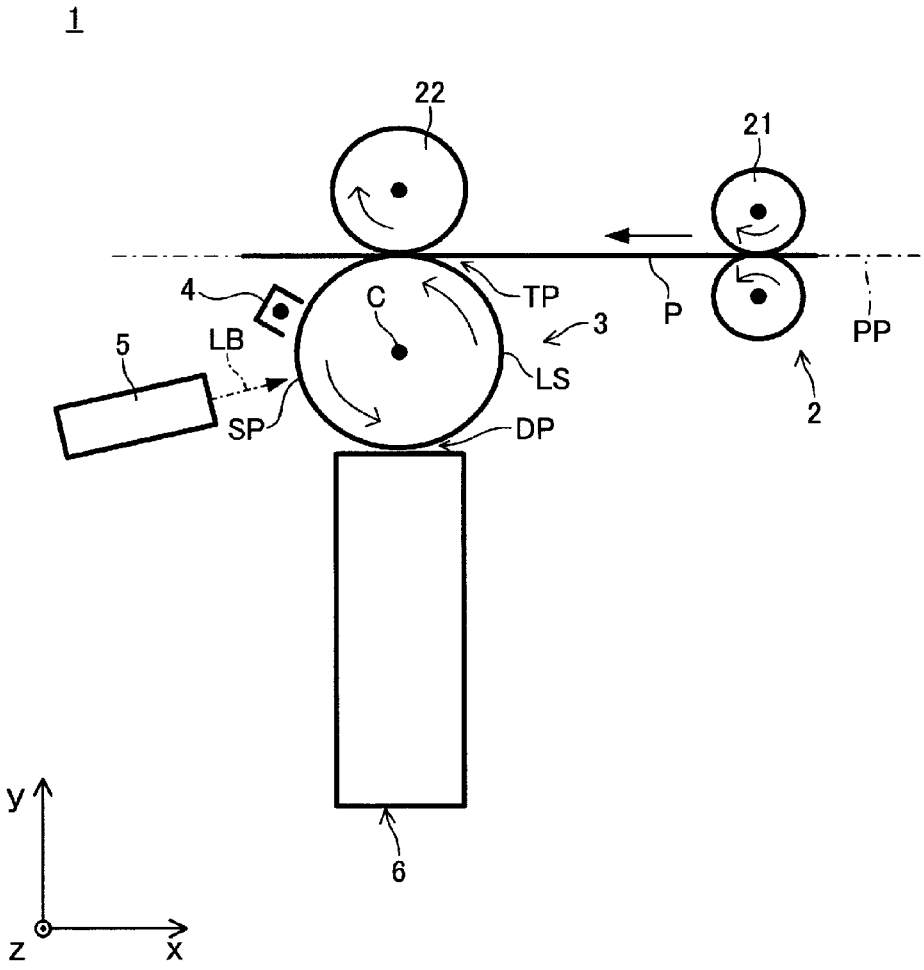
FIG. 1 is a side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6. In the laser printer 1, there are sheets P stacked. The sheet feeding mechanism 2 is configured to feed a sheet P along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1). The electrostatic latent image holding surface LS is configured such that an electrostatic latent image is formed thereon in accordance with an electric potential distribution. Further, the electrostatic latent image holding surface LS is configured to hold toner T (see FIG. 2) in positions corresponding to the electrostatic latent image. The photoconductive drum 3 is driven to rotate in a counterclockwise direction indicated by arrows in FIG. 1 around a central axis C that is parallel to the main scanning direction. Thus, the photoconductive drum 3 is configured to move the electrostatic latent image holding surface LS along an auxiliary scanning direction perpendicular to the main scanning direction.

The electrification device 4 is disposed to face the electrostatic latent image holding surface LS and configured to evenly and positively charge the electrostatic latent image holding surface LS. The scanning unit 5 is configured to converge a laser beam LB modulated based on image data in a scanned position SP on the electrostatic latent image holding surface LS and move (scan) the convergence point of the laser beam LB along the main scanning direction, such that the electrostatic latent image is formed on the electrostatic latent image holding surface LS.

The toner supply device 6 is disposed under the photoconductive body 3 so as to face the electrostatic latent image holding surface LS in a development position DP downstream relative to the scanned position SP in the moving direction of the electrostatic latent image holding surface LS that moves when the photoconductive drum 3 rotates. The toner supply device 6 is configured to supply the charged toner T (see FIG. 2), in the development position DP, onto the electrostatic latent image holding surface LS. Subsequently, a detailed explanation will be provided about a specific configuration of each element included in the laser printer 1.

The sheet feeding mechanism 2 includes a pair of registration rollers 21, and a transfer roller 22. The registration rollers 21 are configured to feed a sheet P toward between the photoconductive drum 3 and the transfer roller 22 at a predetermined moment. The transfer roller 22 is disposed to face the electrostatic latent image holding surface LS across the sheet feeding path PP (the sheet P) in a transfer position TP. Additionally, the transfer roller 22 is driven to rotate in a clockwise direction indicated by an arrow in FIG. 1. The transfer roller 22 is connected to a bias power supply circuit (not shown). Specifically, the transfer roller 22 is configured such that a predetermined transfer bias voltage is applied to between the transfer roller 22 and the photoconductive drum 3 so as to transfer, onto the sheet P, the toner T (see FIG. 2) which adheres onto the electrostatic latent image holding surface LS.

Figure 2:
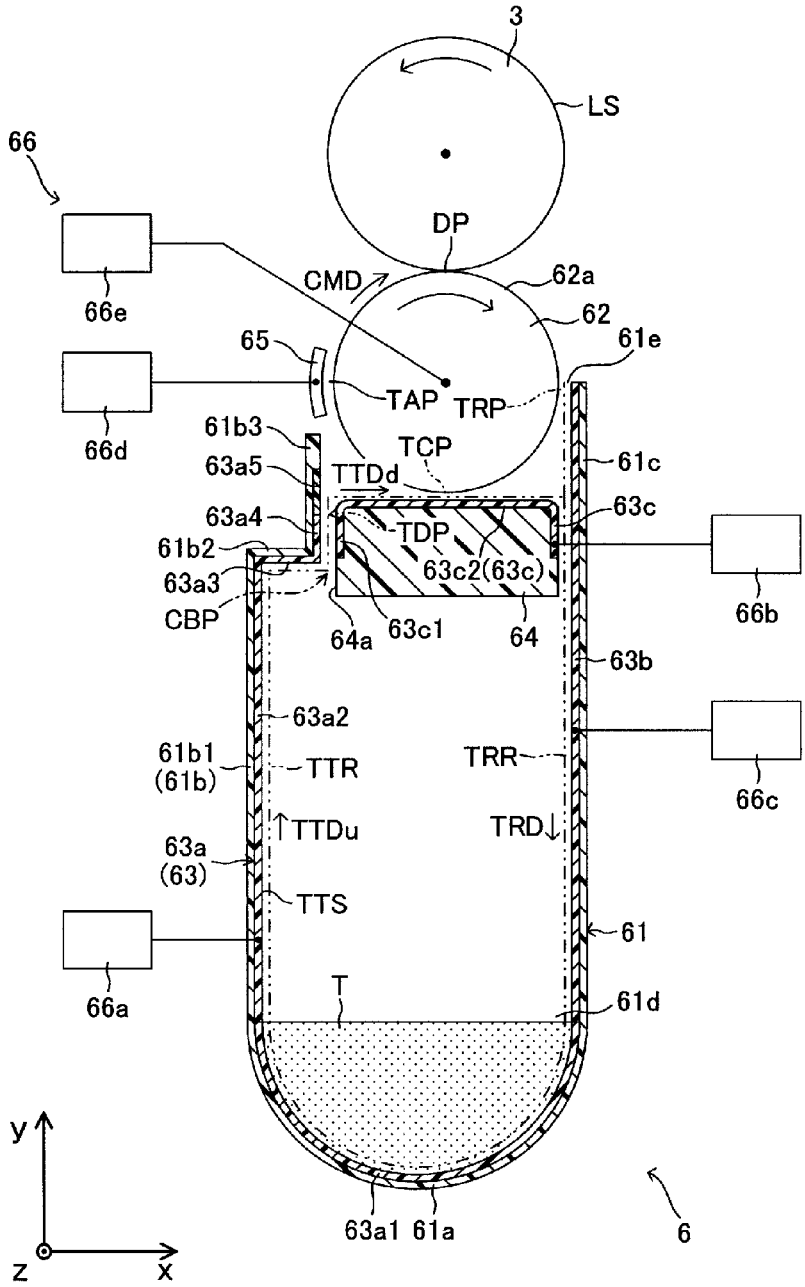
FIG. 2 is an enlarged cross-sectional side view of a toner supply device for the laser printer in the embodiment according to one or more aspects of the present invention.

As depicted in FIG. 2 that is an enlarged cross-sectional side view of the toner supply device 6 shown in FIG. 1, a toner box 61, forming a casing of the toner supply device 6, is a box member that is substantially U-shaped and opened upward when viewed along the main scanning direction (the z-axis direction). Further, the toner box 61 is disposed to have a longitudinal direction parallel to a y-axis direction shown in FIG. 2.

The toner box 61 includes a box bottom wall 61 formed in a half-cylinder shape that has an axis line parallel to the main scanning direction and is opened upward. The box bottom wall 61*a* is provided at a bottom of the toner box 61. Further, the toner box 61 includes a rear panel 61*b* configured to extend upward from an end at a rear side (a left side in FIG. 2) of the box bottom wall 61*a* in a front-to-rear direction (i.e., an x-axis direction).

The rear panel 61*b* includes a first vertical section 61*b*1, a horizontal section 61*b*2, and a second vertical section 61*b*3. The first vertical section 61*b*1 is a flat plate member, parallel to the main scanning direction (the z-axis direction) and the vertical direction (the y-axis direction), which extends upward in a vertical direction (i.e., the y-axis direction) from the aforementioned end of the box bottom wall 61*a*. The horizontal section 61*b*2 is a flat plate member, parallel to a horizontal plane (parallel to the x-axis direction and the z-axis direction), which extends toward a front side (toward the inside of the toner box 61, that is, rightward in FIG. 2) from an upper end of the first vertical section 61*b*1. The second vertical section 61*b*3 is a flat plate member, parallel to the y-axis direction and the z-axis direction, which extends upward in the vertical direction (i.e., the y-axis direction) from a front end of the horizontal section 61*b*2 in the front-to-rear direction (i.e., the x-axis direction). Further, the toner box 61 includes a front panel 61*c* configured to extend upward in the vertical direction (i.e., the y-axis direction) from a front end of the box bottom wall 61*a* in the front-to-rear direction (i.e., an x-axis direction). The front panel 61*c* is a flat plate member parallel to the main scanning direction (the z-axis direction) and the vertical direction (the y-axis direction), which is disposed to face the rear panel 61*b*.

The toner box 61 includes a toner storage section 61*d*, which is a bottom section of an inner space of the toner box 61 and configured to accommodate the toner T (powdered dry-type development agent). It is noted that in the embodiment, the toner T is positively-chargeable nonmagnetic-one-component black toner. Further, the toner box 61 has an opening 61*e* formed in such a position at a top of the toner box 61 as to face the photoconductive drum 3. In other words, the opening 61*e* is opened up toward the photoconductive drum 3.

The development roller 62 is a roller-shaped member having a toner carrying surface 62*a* that is a cylindrical circumferential surface. The development roller 62 is disposed to be opposite and in closest proximity to the photoconductive drum 3 in the development position DP across a predetermined gap. In the embodiment, the development roller 62 is rotatably supported at an upper end of the toner box 61 where the opening 61*e* is formed such that substantially a half of the toner carrying surface 62*a* is exposed to the outside of the toner box 61. The development roller 62 is configured to be driven to rotate in a direction (the clockwise direction in FIG. 2) opposite to the rotational direction of the photoconductive drum 3, such that a toner-carrying-surface moving direction CMD (the moving direction of the toner carrying surface 62*a*) is the same as the moving direction of the electrostatic latent image holding surface LS. In other words, the development roller 62 is driven to rotate in such a direction as if the development roller 62 rotated accompanying the photoconductive drum 3.

The toner box 61 has a transfer board 63 disposed therein. In the embodiment, the transfer board 63 includes an upstream supply board 63*a* (containing a first section 63*a*1, a second section 63*a*2, a third section 63*a*3, a fourth section 63*a*4, and a fifth section 63*a*5), retrieving board 63*b*, and a downstream supply board 63*c*. The transfer board 63 is configured to transfer the toner T along a surface thereof, i.e., a toner transfer surface TTS with a traveling-wave electric field that is generated when multi-phase alternating-current (AC) voltages are applied to the transfer board 63.

Specifically, the first to fourth sections 63*a*1 to 63*a*4 of the upstream supply board 63*a* are configured to transfer the toner T in an upstream toner supply transfer direction TTDu along a toner transfer route TTR. Meanwhile, the fifth section 63*a*5 is configured to transfer the toner T in a direction opposite to the upstream toner supply transfer direction TTDu. In addition, the downstream supply board 63*c* is configured to transfer the toner T in a downstream toner supply transfer direction TTDd along the toner transfer route TTR. Further, the retrieving board 63*b* is configured to transfer the toner T in a toner retrieving direction TRD along a toner retrieving route TRR. In the following description, when the generic name "transfer board 63" is provided to the upstream supply board 63*a*, the retrieving board 63*b*, and the downstream supply board 63*c*, a generic name "toner transfer direction TTD" may be provided to an electric-field transfer direction in which the toner T is transferred by the transfer board 63 (such as the upstream toner supply transfer direction TTDu, the downstream toner supply transfer direction TTDd, and the toner retrieving direction TRD) (see FIG. 3).

The toner transfer route TTR is an electric-field transfer route for the toner T that is formed along the toner transfer surface TTS of the upstream supply board 63*a* and the downstream supply board 63*c*. Further, the toner retrieving route TRR is an electric-field transfer route for the toner T that is formed along the toner transfer surface TTS of the retrieving board 63*b*. Namely, the upstream supply board 63*a* and the downstream supply board 63*c* are disposed along the toner transfer route TTR. Additionally, the retrieving board 63*b* is disposed along the toner retrieving route TRR. In the embodiment, the toner retrieving route TRR is formed to extend downward in the vertical direction (the y-axis direction) from a toner retrieving position TRP to the toner storage section 61*d*. Further, the toner transfer route TTR is formed to extend from the toner storage section 61*d* via a toner carrying position TCP near a downstream end of the toner carrying surface 62*a* and join an upstream end of the toner retrieving route TRR. The toner transfer route TTR and the toner retrieving route TRR form circulation routes that are elongated in the vertical direction (the y-axis direction) when viewed along the main scanning direction (the z-axis direction).

The toner retrieving position TRP is a position where the toner carrying surface 62*a* is opposite and in closest proximity to the retrieving board 63*b*. In the embodiment, the toner retrieving position TRP is located in a position corresponding to an upper end of the retrieving board 63*b* and a front end (a right end in FIG. 2) of the toner carrying surface 62*a*. The toner carrying position TCP is a position where the toner carrying surface 62*a* is opposite and in closest proximity to the downstream supply board 63*c*. In the embodiment, the toner carrying position TCP is located in a position corresponding to a lower end of the toner carrying surface 62*a*.

The upstream toner supply transfer direction TTDu is a direction in which the toner T is transferred along the toner transfer route TTR by the upstream supply board 63*a*, that is, a tangential direction in a given point on the toner transfer route TTR for the upstream supply board 63*a*. In the same manner, the downstream toner supply transfer direction TTDd is a direction in which the toner T is transferred along the toner transfer route TTR by the downstream supply board 63*c*. Further, the toner retrieving direction TRD is a direction in which the toner T is transferred along the toner transfer route TTR by the retrieving board 63*b*. Typically, the toner retrieving direction TRD is a vertically downward direction.

The first section 63*a*1 is a curved-plate section that is disposed at a bottom of the upstream supply board 63*a* and bent in a shape of a half cylinder opened upward. Further, the first section 63*a*1 is supported by an inner wall surface of a box bottom wall 61*a*. Namely, the first section 63*a*1 is disposed at a bottom of the inner space of the toner box 61 to constitute a bottom surface of the toner storage section 61*d*. The second section 63*a*2 is supported by an inner wall surface of the first vertical section 61*b*1 of the rear panel 61*b*. Further, the second section 63*a*2 extends upward in the vertical direction (the y-axis direction) from a rear-side upper end (a downstream end in the upstream toner supply transfer direction TTDu) of the first section 63*a*1.

The third section 63*a*3 is supported by an inner wall surface of the horizontal section 61*b*2 of the rear panel 61*b*, such that the toner transfer surface TTS faces down. Further, the third section 63*a*3 extends from an upper end (a downstream end in the upstream toner supply transfer direction TTDu) of the second section 63*a*2 toward the inside (or the front side) of the toner box 61. The fourth section 63*a*4 is supported by an inner wall surface of the second vertical section 61*b*3 of the rear panel 61*b*. Further, the fourth section 63*a*4 extends upward in the vertical direction (the y-axis direction) from a front end (a downstream end in the upstream toner supply transfer direction TTDu) of the third section 63*a*3. In the embodiment, an upper end (a downstream end in the upstream toner supply transfer direction TTDu) of the fourth section 63*a*4 is disposed lower than the lower end of the development roller 62.

As described above, the third section 63*a*3 and the fourth section 63*a*4 of the upstream supply board 63*a* are connected with each other in a convex shape bending substantially perpendicularly in a convex bending position CBP which is halfway on the toner transfer route TTR. Namely, the third section 63*a*3 is adjacent to the convex bending position CBP at an upstream side relative to the convex bending position CBP on the toner transfer route TTR. Further, the fourth section 63*a*4 is adjacent to the convex bending position CBP at a downstream side relative to the convex bending position CBP on the toner transfer route TTR.

The fifth section 63*a*5 extends further upward in the vertical direction (in the upstream toner supply transfer direction TTDu) from an upper end of the fourth section 63*a*4. The fifth section 63*a*5 is adjacent to the fourth section 63*a*4 at a downstream side relative to a toner delivery position TDP in the upstream toner supply transfer direction TTDu.

The toner delivery position TDP is a position where the upstream supply board 63*a* is opposite and in closest proximity to the downstream supply board 63*c*, which position corresponds to a boundary between the fourth section 63*a*4 and the fifth section 63*a*5. In the embodiment, the toner delivery position TDP is provided downstream in the upstream toner supply transfer direction TTDu relative to a center in an area where the upstream supply board 63*a* faces the downstream supply board 63*c*, when viewed along the main scanning direction (the z-axis direction). Further, the toner delivery position TDP is provided near (slightly lower than or slightly upstream in the upstream toner supply transfer direction TTDu relative to) a position where the toner transfer direction TTD (the toner transfer route TTR) bends from the upstream toner supply transfer direction TTDu (which extends upward in the vertical direction at the fourth section 63*a*4) into the downstream toner supply transfer direction TTDd (which extends substantially horizontally at the downstream supply board 63*c*).

The retrieving board 63*b* is supported by an inner wall surface of the front panel 61*c*. The retrieving board 63*b* is configured to transfer the toner T along the toner-carrying-surface moving direction CMD (in the same direction as the toner-carrying-surface moving direction CMD) in the toner retrieving position TRP.

The downstream supply board 63*c* is housed in the toner box 61, under the development roller 62. The downstream supply board 63*c* includes an upstream section 63*c*1, a central section 63*c*2, and a downstream section 63*c*3. Further, the downstream supply board 63*c* is formed substantially in a reversed U-shape when viewed along the main scanning direction (the z-axis direction). The upstream section 63*c*1 is disposed to bend substantially perpendicularly from an upstream end of the central section 63*c*2 in the downstream toner supply transfer direction TTDd and extend downward in the vertical direction. The central section 63*c*2 is disposed horizontally (parallel to the x-axis direction and the z-axis direction), so as to be opposite and in closest proximity to the toner carrying surface 62*a* in the toner carrying position TCP. The downstream section 63*c*3 is disposed parallel to the retrieving board 63*b*, so as to bend substantially perpendicularly from a downstream end of the central section 63*c*2 in the downstream toner supply transfer direction TTDd and extend downward in the vertical direction.

The upstream section 63*c*1 is disposed parallel to the fourth section 63*a*4 and the fifth section 63*a*5, so as to face the fourth section 63*a*4 and the fifth section 63*a*5 across a predetermined distance above the convex bending position CBP (i.e., above a downstream end of the third section 63*a*3 of the upstream supply board 63*a* in the upstream toner supply transfer direction TTDu). The central section 63*c*2 is configured to transfer the toner T in a direction opposite to the toner-carrying-surface moving direction CMD in the toner carrying position TCP. The downstream section 63*c*3 is configured to transfer the toner T along the toner retrieving direction TRD of the retrieving board 63*b* (in the same direction as the toner retrieving direction TRD).

There is a floating-developer collision member 64 disposed under the development roller 62. The floating-developer collision member 64 has an upper surface that supports the downstream supply board 63*c* and face the development roller 62 across the downstream supply board 63*c*. Further, the floating-developer collision member 64 is disposed adjacent to the downstream end of the third section 63*a*3 of the upstream supply board 63*a* in the upstream toner supply transfer direction TTDu. A rear facing surface 64*a*, which is a rear surface of the floating-developer collision member 64, is disposed parallel to the main scanning direction (the z-axis direction) and the vertical direction (the y-axis direction). Further, the rear facing surface 64*a* is disposed to face an upstream end of the fourth section 63*a*4 in the upstream toner supply transfer direction TTDu and be perpendicular to the upstream toner supply transfer direction TTDu for the third section 63*a*3. Namely, the rear facing surface 64*a* is provided in an area (lower than the upstream section 63*c*1) where the upstream section 63*c*1 of the downstream supply board 63*c* is not supported, such that when the toner T transferred by the third section 63*a*3 goes ahead of the convex bending position CBP, the toner T collides against the rear facing surface 64*a*.

An auxiliary electrification member 65 is disposed to face the toner carrying surface 62*a* in a toner auxiliary charging position TAP between the toner carrying position TCP and the development position DP (i.e., downstream relative to the toner carrying position TCP and upstream relative to the development position DP) in the toner-carrying-surface moving direction CMD. The auxiliary electrification member 65 is configured to charge, in a more adequate and evener fashion, the toner T held on the toner carrying surface 62*a* with an alternating electric field generated between the toner carrying surface 62*a* and the auxiliary electrification member 65. In the embodiment, the auxiliary electrification member 65 is a thin plate member that is bent in an arc shape along the shape of the toner carrying surface 62*a* when viewed along the main scanning direction. The auxiliary electrification member 65 is disposed parallel to the toner carrying surface 62*a*, so as to face the toner carrying surface 62*a* across a predetermined distance of gap.

In the embodiment, the toner carrying position TCP and the toner retrieving position TRP are provided inside the toner box 61. Meanwhile, the auxiliary electrification member 65 is disposed outside the toner box 61. In addition, the downstream supply board 63*c* is disposed to face the photoconductive drum 3 across the development roller 62. Further, the auxiliary electrification member 65 and the retrieving board 63*b* are disposed to face each other across the development roller 62.

The development roller 62, the transfer board 63, and the auxiliary electrification member 65 are electrically connected with a power supply circuit 66. The power supply circuit 66 includes an upstream supply transfer power supply circuit 66*a*, a downstream supply transfer power supply circuit 66*b*, a retrieval power supply circuit 66*c*, a charge bias power supply circuit 66*d*, and a development bias power supply circuit 66*e*. The upstream supply transfer power supply circuit 66*a* is electrically connected with the upstream supply board 63*a*. The downstream supply transfer power supply circuit 66*b* is electrically connected with the downstream supply board 63*c*. The retrieval power supply circuit 66*c* is electrically connected with the retrieving board 63*b*. The charge bias power supply circuit 66*d* is electrically connected with the auxiliary electrification member 65. The development bias power supply circuit 66*e* is electrically connected with the development roller 62.

The upstream supply transfer power supply circuit 66*a*, the downstream supply transfer power supply circuit 66*b*, the retrieval power supply circuit 66*c*, and the development bias power supply circuit 66*e* are configured to output a voltage required for circulation of the toner T along the toner transfer route TTR and the toner retrieving route TRR. The charge bias power supply circuit 66*d* is configured to output a voltage required for generating an alternating electric field in a position where the development roller 62 (the toner carrying surface 62*a*) faces the auxiliary electrification member 65 and charging, in a more adequate and evener fashion, the toner T held on the toner carrying surface 62*a* with the alternating electric field.

Figure 3:
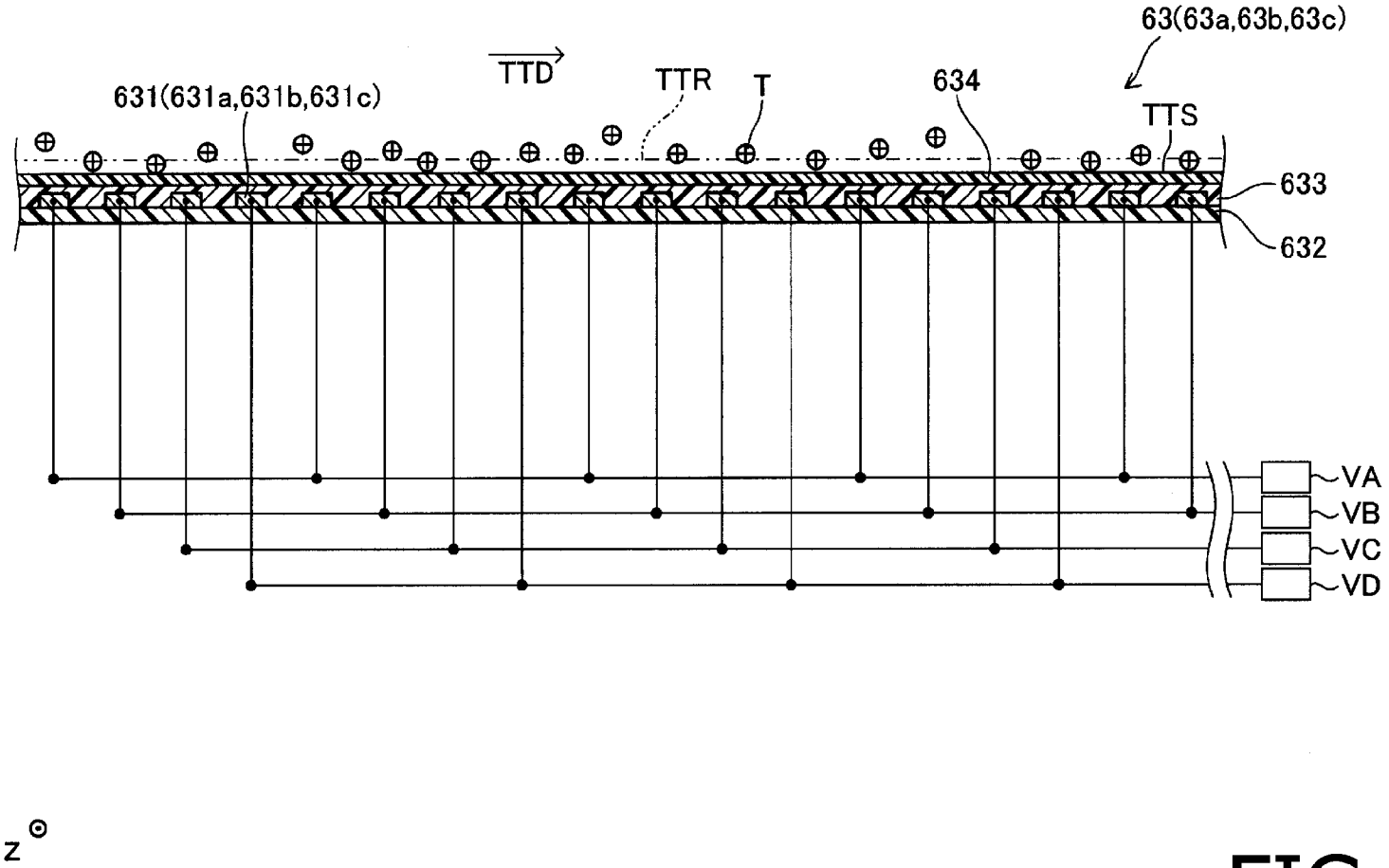
FIG. 3 is an enlarged cross-sectional side view of a transfer board for the toner supply device in the embodiment according to one or more aspects of the present invention.

Referring to FIG. 3, the transfer board 63 includes a plurality of transfer electrodes 631 that are arranged parallel to each other along the toner transfer direction TTD or the toner transfer route TTR at intervals of a predetermined distance. The transfer board 63 is configured to transfer the toner T in the toner transfer direction TTD with a traveling-wave electric field that is generated when a multi-phase AC voltage is applied to each of the plurality of transfer electrodes. Referring to FIGS. 2 and 3, the transfer electrodes 631 of the upstream supply board 63*a* will be referred to as upstream supply transfer electrodes 631*a*. The transfer electrodes 631 of the retrieving board 63*b* will be referred to as retrieving electrodes 631*b*. The transfer electrodes 631 of the downstream supply board 63*c* will be referred to as downstream supply transfer electrodes 631*c*.

The transfer electrodes 631 are linear wiring patterns elongated in a direction parallel to the main scanning direction (i.e., perpendicular to the auxiliary scanning direction). The transfer electrodes 631 are formed with copper thin films. The transfer electrodes 631 are arranged along the toner transfer route TTR so as to be parallel to each other. Every fourth one of the first transfer electrodes 631 is connected with a specific one of four power supply circuits VA, VB, VC, and VD. In other words, the first transfer electrodes 631 are arranged along the toner transfer route TTR in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . (it is noted that the power supply circuits VA, VB, VC, and VD are included in the upstream supply transfer power supply circuit 66*a* shown in FIG. 2).

The transfer board 63 is a thin plate member configured in the same manner as a flexible printed-circuit board. Specifically, the transfer board 63 includes the transfer electrodes 631, a transfer electrode supporting film 632, a transfer electrode coating layer 633, and a transfer electrode overcoating layer 634. The transfer electrodes 631 are formed on a surface of the transfer electrode supporting film 632. The transfer electrode supporting film 632 is a flexible film made of electrically insulated synthetic resin. The transfer electrode coating layer 633 is made of electrically insulated synthetic resin. The transfer electrode coating layer 633 is provided to coat the transfer electrodes 631 and the surface of the transfer electrode supporting film 632 on which the transfer electrodes 631 are formed. On the transfer electrode coating layer 633, the transfer electrode overcoating layer 634 is provided.

<Operations>

Subsequently, operations of the toner supply device 6 configured as above will be outlined with reference to the relevant drawings. FIG. 4 exemplifies output waveforms, which are generated respectively by the power supply circuits VA, VB, VC, and VD shown in FIG. 3. As illustrated in FIG. 4, the power supply circuits VA, VB, VC, and VD are configured to generate respective AC driving voltages having substantially the same waveform with a phase difference of 90 degrees between any adjacent two of the power supply circuits VA, VB, VC, and VD in the aforementioned order.

Referring to FIGS. 2 and 3, charged toner T, of the toner T stored in the toner box 61, which is in contact with or in proximity to the transfer electrode overcoating layer 634 of the first section 63*a*1 of the upstream supply board 63*a*, is transferred to the second section 63*a*2 by the traveling-wave electric field that is generated when the voltages are applied to the upstream supply transfer electrodes 631*a*. The toner T, transferred from the first section 63*a*1 to the second section 63*a*2, is conveyed in the vertically-upward upstream toner supply transfer direction TTDu by the second section 63*a*2. After passing through the second section 63*a*2, subsequently, the toner T is transferred horizontally on the down-facing toner transfer surface TTS of the third section 63*a*3.

In the meantime, the toner T, transferred from the first section 63*a*1 to the second section 63*a*2, contains inadequately charged toner (e.g., negatively charged toner, poorly charged toner, and uncharged toner). According to computer simulation to have behaviors of the toner T being transferred with the traveling-wave electric field on the transfer board 63 as shown in FIG. 3, the toner T shows such behavior that the toner T is divided into two layers, i.e., a lower layer close to the surface of the transfer board 63 and an upper layer of floating toner away from the surface of the transfer board 63. The lower layer tends to include a relatively large amount of adequately charged toner, while the upper layer tends to include a relatively large amount of inadequately charged toner such as negatively charged toner.

In the embodiment, when the toner T is transferred upward in the vertical direction on the second section 63*a*2 or transferred horizontally on the down-facing toner transfer surface TTS of the third section 63*a*3, a part of a large amount of inadequately charged toner T included in the floating toner drops down off the toner transfer route TTR. Thereby, the adequately charged toner T is sorted out, to a certain extent, from the inadequately charged toner T. The toner T, which drops down off the toner transfer route TTR, returns to the toner storage section 61*d*.

Subsequently, the toner T, sorted out to a certain extent on the second section 63*a*2 and the third section 63*a*3, reaches the convex bending position CBP. In the convex bending position CBP, the toner transfer route TTR bends upward in the vertical direction from the horizontal direction. At this time, the floating toner, which cannot follow the bending toner transfer route TTR (the bending between different directions in which the toner T is transferred), collides against the rear facing surface 64*a* of the floating-developer collision member 64. After colliding against the rear facing surface 64*a*, the floating toner falls into a lower space where none of the third section 63*a*3 and the fourth section 63*a*4 exists, and returns into the toner storage section 61*d*. Namely, the toner T being transferred by the third section 63*a*3 is further sorted out in the convex bending position CBP.

After passing through the convex bending position CBP, the toner T is transferred to the fourth section 63*a*4, and conveyed to the toner delivery position TDP in the downstream toner supply transfer direction TTDd (upward in the vertical direction). Then, in a position where the fourth section 63*a*4 faces the upstream section 63*c*1 of the downstream supply board 63*c*, the toner T is transferred from the upstream supply board 63*a*4 to the upstream section 63*c*1 of the downstream supply board 63*c*.

In the embodiment, at the fifth section 63*a*5, an electric field is generated to transfer the toner T in a direction opposite to the downstream toner supply transfer direction TTDd. Therefore, the toner T hops in a favorable manner to the upstream section 63*c*1 of the downstream supply board 63*c* in and around the toner delivery position TDP, without passing through the toner delivery position TDP or going out of the toner box 61 via the opening 61*e*. Accordingly, after conveyed to the toner delivery position TDP by the fourth section 63*a*4, the toner T is transferred to the downstream supply board 63*c* in a favorable manner. In addition, it is possible to avoid an undesired situation that a part of the toner T passes through the toner delivery position TDP and a position therearound, goes out of the casing 61 via the opening 61*e*, and adheres to the auxiliary electrification member 65.

After receiving the toner T at the upstream section 63*c*1, the downstream supply board 63*c* transfers the toner T in the downstream toner supply transfer direction TTDd opposite to the toner carrying surface moving direction CMD, at the central section 63*c*2 facing the development roller 62. Then, in the toner carrying position TCP, the toner T is supplied to the toner carrying surface 62*a*. Thereby, the adequately charged toner T is held and carried on the toner carrying surface 62*a* in a favorable manner. the toner T, which has not been transferred to the toner carrying surface 62*a* in the toner carrying position TCP, is transferred to (retrieved by) the retrieving board 63*b* at the downstream section 63*c*3. Then, the retrieved toner T is conveyed to the toner storage section 61*d* by the retrieving board 63*b*.

When the development roller 62 is driven to rotate, the toner carrying surface 62*a* carrying the toner T moves from the toner carrying position TCP to the development position DP in the toner carrying surface moving direction CMD. During this time period, the toner T, held on the toner carrying surface 62*a*, is charged more and evenly by the auxiliary charging member 65 in the toner auxiliary charging position TAP. Then, when the toner carrying surface 62*a* reaches a position near the development position DP after passing through the toner auxiliary charging position TAP, the toner T is supplied to the development position DP. Thereby, the electrostatic latent image formed on the electrostatic latent image holding surface LS is developed with the toner T. Namely, the toner T adheres to an area with no positive charge on the electrostatic latent image holding surface LS.

When the development roller 62 rotates, the toner carrying surface 62*a*, which carries the toner T left thereon without being transferred to the electrostatic latent image holding surface LS in the development position DP, reaches the toner retrieving position TRP. In the toner retrieving position TRP, the toner T remaining on the toner carrying surface 62*a* is retrieved by the retrieving board 63*b*. It is noted that the retrieving board 63*b* generates the traveling-wave electric field to transfer the toner T in the toner retrieving direction TRD which is the same direction as the toner carrying surface moving direction CMD in the toner retrieving position TRP. Then, the toner T is conveyed to the toner storage section 61*d* by the retrieving board 63*b*.

In the embodiment, the upstream supply board 63*a* and the downstream supply board 63*c*, which are configured to convey the toner T from the toner storage section 61*d* to the toner carrying position TCP and supply the toner T to the toner carrying surface 62*a* in the toner carrying position TCP, are provided to transfer the toner T in a direction opposite to the toner carrying surface moving direction CMD in the toner carrying position TCP. Further, the retrieving board 63*b*, which is configured to retrieve the toner T left on the toner carrying surface 62*a* that has passed through the development position DP, is supported by the inner wall surface of the front panel 61*c* of the toner box 61 and configured to transfer the toner T in the same direction as the toner carrying surface moving direction CMD in the toner retrieving position TRP.

According to the toner supply device 6 configured as above, a space for accommodating the auxiliary electrification member 65 is adequately secured in an area that is upstream relative to the development position DP and downstream relative to the toner carrying position TCP in the toner carrying surface moving direction CMD. Thus, it is possible to downsize the toner supply device 6 and make the toner held on the toner carrying surface 62*a* in a favorable manner.

On the contrary, when the retrieving board 63*b* is provided to transfer the toner T in a direction opposite to the toner carrying surface moving direction CMD in the toner retrieving position TRP, it is impossible to support the retrieving board 63*b* on the inner wall surface of the front panel 61*c*. Thus, in this case, it is difficult to downsize the toner supply device 6.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

Aspects of the present invention may be applied to electrophotographic image forming devices such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in a shape of a plate or an endless belt. Additionally, light sources (e.g., LEDs, electroluminescence devices, and fluorescent substances) other than a laser scanner may be employed as light sources for exposure. Alternatively, aspects of the present invention may be applied to image forming devices employing methods other than the aforementioned electrophotographic method (e.g., a toner-jet method using no photoconductive body, an ion flow method, and a multi-stylus electrode method).

Referring to FIG. 4, the voltages generated by the power supply circuits VA, VB, VC, and VD may have an arbitrary waveform (e.g., a sinusoidal waveform and a triangle waveform) other than the rectangle waveform as exemplified in the aforementioned embodiment. Further, in the aforementioned embodiment, the four power supply circuits VA, VB, VC, and VD are provided to generate the respective AC driving voltages with a phase difference of 90 degrees between any adjacent two of the power supply circuits VA, VB, VC, and VD in the aforementioned order. However, three power supply circuits may be provided to generate respective AC driving voltages with a phase difference of 120 degrees between any two of the three power supply circuits.

The photoconductive drum 3 and the development roller 62 may contact each other. Further, the configuration of the first electric-field transfer board 63 is not limited to that exemplified in the aforementioned embodiment. For instance, the first electric-field transfer board 63 may be configured without the overcoating layer 634.

The central section 63*c*2 may include a portion that is formed in a shape of an arc along the toner carrying surface 62*a* when viewed along the main scanning direction. In this case, the arc-shaped portion may be provided to face the toner carrying surface 62*a* across a predetermined distance of gap. Further, at least one of the second section 63*a*2 and the fourth section 63*a*4 may be somewhat slanted relative to the vertical direction. Additionally, the retrieving board 63*b* may be somewhat slanted relative to the vertical direction. Furthermore, the third section 63*a*3 may be somewhat slanted relative to the horizontal surface.

Namely, the toner supply device 6 may be configured to be turned clockwise by several degrees to 90 degrees from the state shown in FIG. 2. When the toner supply device 6 is turned clockwise by 90 degrees in FIG. 2, the second section 63*a*2 and the retrieving board 63*b* are configured to transfer the toner T horizontally. Further, in this case, a concave portion may be provided at a downstream side of the front panel 61*c* in the toner retrieving direction TRD, such that a bottom of the toner storage section 61*d* is lower than the retrieving board 63*b*.

A lower end of the upstream section 63*c*1 of the downstream supply board 63*c* may be disposed ahead of a downstream end of the third section 63*a*3 in the upstream toner supply transfer direction TTDu. Namely, the upstream section 63*c*1 may be disposed in a position where the toner T may collide against the upstream section 63*c*1 when the toner T transferred by the third section 63*a*3 goes straight ahead of the convex bending position CBP.

At least a part of the downstream supply board 63*c* may be omitted. In this case, for instance, the fourth section 63*a*4 may be extended upward such that an upper end thereof in the upstream toner supply transfer direction TTDu is provided in a point as high as the central axis of the development roller 62. In this case, a position near the upper end of the fourth section 63*a*4 where the fourth section 63*a*4 is opposite and in closest proximity to the toner carrying surface 62*a* may double as the toner delivery position TDP and the toner carrying position TCP.

The rear facing surface 64*a* of the floating-developer collision member 64 may be formed from material selectable so as to charge the toner T to a desired one of positive and negative polarities (in the aforementioned embodiment, to the positive polarity) when the toner T collides against the rear facing surface 64*a*.

As illustrated in FIG. 5, the upstream supply board 63*a* may be configured integrally with the downstream supply board 63*c*. In this case, typically, the integrated board of the upstream supply board 63*a* and the downstream supply board 63*c* may be formed in a reversed J-shape, a reversed L-shape, or a reversed U-shape. Further, the integrated board may be housed in the toner box 61 in a position away from the rear panel 61*b* and the front panel 61*c*.

Further, the toner supply device 6 may includes a shield member 67 disposed between the toner carrying position TCP and the auxiliary electrification member 65. The shield member 67 may be configured to extend toward the development roller 62 from an upper end of the rear panel 61*b*. In this configuration, the shield member 67 makes it possible to prevent in a favorable manner the toner T being transferred by the upstream supply board 63*a* and the downstream supply board 63*c* from going out of the casing 61 via the opening 61*e*. Further, the shield member may be formed integrally with the rear panel 61*b*. Namely, the shield member 67 may be formed as an upper end portion of the rear panel 61*b*.

What is claimed is:

1. A developer supply device configured to supply charged development agent to an intended device, comprising:

a developer carrying body comprising a developer carrying surface that is configured to carry the development agent thereon, formed as a cylindrical circumferential surface parallel to a first direction, and disposed to face the intended device in a first position where the development agent held on the developer carrying surface is supplied to the intended device, wherein the developer carrying body is configured to rotate around an axis parallel to the first direction such that the developer carrying surface moves in a second direction perpendicular to the first direction;

a casing comprising:

an opening opened toward the intended device; and a developer storage section configured to store the development agent therein, wherein the casing is configured to rotatably support the developer carrying body near the opening;

a first transfer board housed in the casing so as to face the developer carrying surface in a second position, the second position, where the developer carrying surface faces an inside of the casing, being located upstream relative to the first position in the second direction, wherein the first transfer board is configured to:

transfer the development agent from the developer storage section to the second position with a traveling-wave electric field generated when a multi-phase alternating-current voltage is applied to the first transfer board, such that the development agent is supplied onto the developer carrying surface in the second position, and transfer the development agent in a direction opposite to the second direction in the second position;

an electrification member disposed to face the developer carrying surface in a third position that is located downstream relative to the second position and upstream relative to the first position in the second direction, wherein the electrification member is configured to further charge the development agent supplied onto the developer carrying surface in the third position with an alternating electric field generated between the developer carrying body and the electrification member;

a second transfer board that is supported by an inner wall surface of the casing so as to face the developer carrying surface in a fourth position that is located downstream relative to the first position and upstream relative to the second position in the second direction, wherein the second transfer board is configured to transfer the development agent to the developer storage section in a direction identical to the second direction in the fourth position, with a traveling-wave electric field generated when a multi-phase alternating-current voltage is applied to the second transfer board; and a shield member disposed between the second position and the electrification member.

2. The developer supply device according to claim 1, wherein the electrification member and the second transfer board are disposed to face each other across the developer carrying body, and wherein the first transfer board is disposed to face the intended device across the developer carrying body.

3. The developer supply device according to claim 1, wherein the electrification member is disposed outside the casing, and wherein the shield member is configured to prevent the development agent being transferred by the first transfer board from going out of the casing via the opening.

4. The developer supply device according to claim 1, wherein the first transfer board comprises a downstream end that is provided downstream in a transfer direction in which the development agent is transferred by the first transfer board and configured to face the second transfer board.

5. The developer supply device according to claim 1, wherein the first transfer board comprises:

a first section that is disposed in the casing and configured to face the developer carrying surface in the second position; and a second section that is supported by an inner wall surface of the casing and configured to face an upstream end of the first section in a transfer direction in which the development agent is transferred by the second section.

6. The developer supply device according to claim 5, wherein the second section comprises:

a first vertical section configured to transfer the development agent upward substantially in a vertical direction;

a down-facing section configured to transfer the development agent transferred by the first vertical section, on a down-facing surface of the down-facing section substantially in a horizontal direction; and a second vertical section configured to transfer the development agent transferred by the down-facing section, upward substantially in the vertical direction.

7. The developer supply device according to claim 6, further comprising a collision member disposed adjacent to a downstream end of the down-facing section in a transfer direction in which the development agent is transferred by the down-facing section, such that when the development agent transferred by the down-facing section goes straight ahead of the downstream end of the down-facing section, the development agent collides against the collision member.

8. The developer supply device according to claim 1, wherein the second position is provided in the casing.

9. An image forming apparatus comprising:

a photoconductive body configured to form a developer image thereon; and a development agent supply device configured to supply charged development agent to the photoconductive body, wherein the development agent supply device comprises:

a developer carrying body comprising a developer carrying surface that is configured to carry the development agent thereon, formed as a cylindrical circumferential surface parallel to a first direction, and disposed to face the photoconductive body in a first position where the development agent held on the developer carrying surface is supplied to the photoconductive body, wherein the developer carrying body is configured to rotate around an axis parallel to the first direction such that the developer carrying surface moves in a second direction perpendicular to the first direction;

a casing comprising:

an opening opened toward the photoconductive body; and a developer storage section configured to store the development agent therein, wherein the casing is configured to rotatably support the developer carrying body near the opening;

a first transfer board housed in the casing so as to face the developer carrying surface in a second position, the second position, where the developer carrying surface faces an inside of the casing, being located upstream relative to the first position in the second direction, wherein the first transfer board is configured to:

transfer the development agent from the developer storage section to the second position with a traveling-wave electric field generated when a multi-phase alternating-current voltage is applied to the first transfer board, such that the development agent is supplied onto the developer carrying surface in the second position, and transfer the development agent in a direction opposite to the second direction in the second position;

an electrification member disposed to face the developer carrying surface in a third position that is located downstream relative to the second position and upstream relative to the first position in the second direction, wherein the electrification member is configured to further charge the development agent supplied onto the developer carrying surface in the third position with an alternating electric field generated between the developer carrying body and the electrification member; and a second transfer board that is supported by an inner wall surface of the casing so as to face the developer carrying surface in a fourth position that is located downstream relative to the first position and upstream relative to the second position in the second direction; and a shield member disposed between the second position and the electrification member, wherein the second transfer board is configured to transfer the development agent to the developer storage section in a direction identical to the second direction in the fourth position, with a traveling-wave electric field generated when a multi-phase alternating-current voltage is applied to the second transfer board.

10. The image forming apparatus according to claim 9, wherein the electrification member and the second transfer board are disposed to face each other across the developer carrying body, and wherein the first transfer board is disposed to face the photoconductive body across the developer carrying body.

11. The image forming apparatus according to claim 9, wherein the electrification member is disposed outside the casing, and wherein the shield member is configured to prevent the development agent being transferred by the first transfer board from going out of the casing via the opening.

12. The image forming apparatus according to claim 9, wherein the first transfer board comprises a downstream end that is provided downstream in a transfer direction in which the development agent is transferred by the first transfer board and configured to face the second transfer board.

13. The image forming apparatus according to claim 9, wherein the first transfer board comprises:

a first section that is disposed in the casing and configured to face the developer carrying surface in the second position; and a second section that is supported by an inner wall surface of the casing and configured to face an upstream end of the first section in a transfer direction in which the development agent is transferred by the second section.

14. The image forming apparatus according to claim 13, wherein the second section comprises:

a first vertical section configured to transfer the development agent upward substantially in a vertical direction;

a down-facing section configured to transfer the development agent transferred by the first vertical section, on a down-facing surface of the down-facing section substantially in a horizontal direction; and a second vertical section configured to transfer the development agent transferred by the down-facing section, upward substantially in the vertical direction.

15. The image forming apparatus according to claim 14, wherein the developer supply device further comprises a collision member disposed adjacent to a downstream end of the down-facing section in a transfer direction in which the development agent is transferred by the down-facing section, such that when the development agent transferred by the down-facing section goes straight ahead of the downstream end of the down-facing section, the development agent collides against the collision member.

16. The image forming apparatus according to claim 9, wherein the second position is provided in the casing.

* * * * *